US009557136B2

(12) United States Patent
Hedberg

(10) Patent No.: US 9,557,136 B2
(45) Date of Patent: Jan. 31, 2017

(54) PAINTBALL LOADER

(71) Applicants: Xeon Paintball AB, Väring (SE); HK Army, Inc., Gardena, CA (US)

(72) Inventor: Daniel Hedberg, Väring (SE)

(73) Assignees: XEON PAINTBALL AB, Varing (SE); HK ARMY, INC., Gardena, CA (US)

( * ) Notice: Subject to any disclaimer, the term of this patent is extended or adjusted under 35 U.S.C. 154(b) by 0 days.

(21) Appl. No.: 15/051,199

(22) Filed: Feb. 23, 2016

(65) Prior Publication Data

US 2016/0245614 A1 Aug. 25, 2016

(30) Foreign Application Priority Data

Feb. 24, 2015 (EP) ..... 15156379

(51) Int. Cl.
*F41B 11/52* (2013.01)
*F41B 11/53* (2013.01)
*F41B 11/57* (2013.01)

(52) U.S. Cl.
CPC ..... *F41B 11/53* (2013.01); *F41B 11/52* (2013.01); *F41B 11/57* (2013.01)

(58) Field of Classification Search
CPC ..... F41B 11/52; F41B 11/53; F41B 11/57
USPC ..... 124/45, 48, 49, 51.1, 52
See application file for complete search history.

(56) References Cited

U.S. PATENT DOCUMENTS 5,673,679 A * 10/1997 Walters ..... F41B 11/52 124/49
6,327,953 B1 * 12/2001 Andresen ..... F41A 9/02 124/45
6,644,293 B2 * 11/2003 Jong ..... A45F 5/02 124/52
6,915,792 B1 * 7/2005 Sheng ..... F41B 11/53 124/48
7,357,130 B2 * 4/2008 Broersma ..... F41B 11/53 124/51.1
7,428,899 B2 * 9/2008 Andresen ..... F41B 11/53 124/48

(Continued)

OTHER PUBLICATIONS

Extended European Search Report issued Jul. 31, 2015, by the European Patent Office in corresponding European Patent Application No. 15156379.8-1655. (6 pages).

*Primary Examiner* — Alexander Niconovich
(74) *Attorney, Agent, or Firm* — Buchanan Ingersoll & Rooney P.C.

(57) ABSTRACT

A paintball loader comprising a paintball storage compartment for holding a supply of paintballs, a frame supporting a paintball feeding arrangement for actively feeding paintballs in the compartment through an outlet, a supporting plate, at least two abutments, and a suspension member having one end operatively connected to a central region of the supporting plate and a second end operatively connected to the frame, the suspension member being spring loaded to press the supporting plate against the abutments in a direction substantially opposite the feeding direction. The supporting plate is depressable against a force of the spring loaded suspension member, for moving said supporting plate in the feeding direction A from a first position, in which the supporting plate is pressed against said abutments and serves to guide paintballs in said compartment towards said points of entry, to a second, depressed position.

12 Claims, 6 Drawing Sheets

(56) References Cited

U.S. PATENT DOCUMENTS

| | | | | |
|---|---|---|---|---|
| 8,091,541 | B2 * | 1/2012 | Andresen | F41B 11/53 124/48 |
| 8,210,159 | B1 * | 7/2012 | Neumaster | F41B 11/53 124/49 |
| 8,235,030 | B2 * | 8/2012 | Kaakkola | F41B 11/52 124/49 |
| 8,950,386 | B2 * | 2/2015 | Hedberg | F41B 11/52 124/48 |
| 2007/0028908 | A1 * | 2/2007 | Deak | F41B 11/52 124/73 |
| 2010/0095942 | A1 * | 4/2010 | Kaakkola | F41B 11/53 124/48 |
| 2012/0103316 | A1 | 5/2012 | Kaakkola et al. | |
| 2014/0041646 | A1 * | 2/2014 | Middlebrook | F41B 11/53 124/51.1 |

* cited by examiner

PAINTBALL LOADER

TECHNICAL FIELD

The present invention relates to a paintball loader for a paintball marker (or paintball gun) including a paintball storage compartment for holding a supply of paintballs, an outlet through which a paintball may pass in a feeding direction into a paintball marker on which the loader is mounted, a frame for supporting a paintball feeding arrangement for actively feeding paintballs in the compartment through the outlet, the feeding arrangement having one or several points of entry for receiving a paintball, wherein a surface of the frame has such a form that, when the paintball loader is held in an upright position, the surface slopes towards the points of entry.

BACKGROUND OF THE INVENTION

A paintball marker uses compressed gas, such as air or nitrogen, to propel spherical projectiles including a colored liquid enclosed in a fragile gelatin casing. The projectiles are called paintballs, and they were originally used e.g. to mark objects, hence the name paintball marker.

Today, paintball markers are widely used for target practice and in mock war games, where participants try to "mark" members of another team to send them of the game field. In such games, it is critical to have markers with high capacity (many balls), rapid firing and satisfactory reliability (no jamming balls, etc).

A paintball marker is normally provided with a paintball loader mounted on the upper side of the marker. The loader is essentially a container for holding a supply of paintballs to be loaded into the marker. The balls are fed through an outlet into the marker, where they are pushed through the barrel of the marker by means of e.g. compressed air. In many paintball loaders, the paintballs are simply pulled by gravity through the outlet. More sophisticated loaders, however, typically employ some kind of battery powered feeding arrangement, which uses force to feed the paintballs through the outlet and into the marker. Such a mechanism increases the firing rate and reduces the risk of paintball jam. The feeding arrangement also ensures that the marker can be used also when not held in an upright position.

In later years, significant efforts have been made to improve the performance of paintball markers and in particular the paintball loaders. Such improvements include various types of feeding arrangements, see e.g. U.S. Pat. No. 8,950,386 to the present inventor.

Another area subject to improvement is the holding capacity of the loader, i.e. the number of paintballs it can hold. For example, document US 2012/103316 shows a paintball loader including a ramp member which is pivotable between two positions. In a first, lowered position, the ramp is depressed to increase the free volume of the loader, so as to hold a maximum number of balls. In a second, raised position, the ramp is elevated to form a ramp sloping in the direction of the feeding arrangement.

However, the force required to depress the ramp in US 2012/103316 is significantly weaker at the end of the ramp furthest away from the pivoting edge, and significantly stronger closer to the edge. This provides an unsatisfactory pressure distribution and function, Also, the ramp in US 2012/103316 provides rather limited additional storage. It would be desirable to even further increase the holding capacity of paintball loaders.

GENERAL DISCLOSURE OF THE INVENTION

It is an object of the present invention to further improve the holding capacity of paintball loaders.

According to the present invention, this object is achieved by a paintball loader of the type mentioned by way of introduction, including a supporting plate, having a front end facing the a firing direction, and a rear end opposite the front end, at least two abutments, and a suspension member having one end operatively connected to a central region of the supporting plate and a second end operatively connected to the frame, the suspension member being spring loaded to press the supporting plate against the abutments in a direction substantially opposite the feeding direction. The supporting plate is depressable against a force of said spring loaded suspension member, for moving the supporting plate in the feeding direction from a first position, in which the supporting plate is pressed against the abutments and serves to guide paintballs in the compartment towards the points of entry, to a second, depressed position.

By "front" and "rear" is here intended to indicate towards a front end and towards a rear end, respectively, of a paintball marker on which the loader is mounted. As indicated above, the "front" will be facing the intended firing direction, i.e. the direction in which paintballs will be discharged by a paintball marker on which the loader is mounted.

The design according to the present invention, with a spring loaded suspension member arranged between the plate and the frame, allows all parts of the plate to be resiliently moved in the feeding direction. The available volume for receiving and holding paintballs can thus be increased by depressing the supporting plate. Thereby, more paintballs can be held in the paintball loader. As a representative example, an additional ten paintballs can be held.

Conventionally, the entire volume for holding paintballs is located above the point of entry of the feeding arrangement when the marker is in its upright position, so that balls can roll or fall into the feeding arrangement. According to the present invention, the entire supporting surface is depressable. This makes additional space available below the upper surface of the feeding arrangement, where normally the paintballs would risk getting stuck. According to the invention, however, the biasing member will press the supporting plate into contact with the abutment surfaces and back into its first position. The abutment surfaces can be configured so that any paintballs resting on the supporting plate in its first position easily can find their way into the feeding arrangement.

In one embodiment, the supporting plate is, in the second position, moved completely beyond the points of entry in said feeding direction, i.e. below the openings of the feeding arrangement when the loader is in its upright position.

The suspension member will transfer to spring loading to the central region of the plate, such that the force required to depress the plate can be more evenly distributed. It should be noted that the exact distribution of force required to depress the plate will be determined by the location of the connection between the plate and the suspension member, as well as the location of any abutments between the plate and the suspension member.

According to a preferred embodiment, the first end of said suspension member is connected to the plate so as to be rotatable around a first axis. This enables the plate to be depressed in any orientation, while transferring motion to the suspension member.

Similarly, the second end of said suspension member can be connected to the frame so as to be rotatable around a second axis, parallel to the first axis. The suspension will thus act as a fulcrum lever, so that a large movement of the plate close to the first axis will result in a small movement close to the second axis.

The suspension member can be spring loaded by at least one biasing element (such as a coil spring) provided between the frame and said suspension member. Preferably, such biasing element(s) is/are arranged relatively closer to the second axis than the first axis. In this way, the action of the biasing elements can make use of the fulcrum effect.

The abutments may include a front abutment formed in the frame and arranged to abut a front portion of the plate. Such an abutment will have the effect that when the plate is subject to a pressing force (in the feeding direction) rear of the first axis, the plate will rotate around the first axis. The front end of the plate will then be pressed against the front abutment, while the central region will be pressed against the suspension member, and force the suspension member to rotate against the spring loading.

The abutments may further include a central abutment formed in the first end of the suspension member and arranged to abut an underside of the plate in a point located between the first abutment and the first axis (C). Such an abutment will have the effect that when the plate is subject to a force in front of the first axis, the plate will be pressed against the central abutment and force the suspension member to rotate against the spring loading.

The abutments may also include a rear abutment formed in the frame and arranged to abut a rear portion of the plate. Such a rear abutment may substitute the central abutment. In that case, a force acting in front of the first axis will have a similar effect as a force acting rear of the first axis as was described above. However, such a rear abutment may also be provided onlyl for alignment purposes, to ensure that the rear edge of the plate is in a desired position with respect to the entry points of the feeding arrangement.

According to one embodiment, the suspension member is generally V-shaped, with two legs which are joined in the first end of the suspension member and separated in the second end of the suspension member. The suspension member will thus have two points of connection with the frame, preventing any rotation around an axis perpendicular to the first and second axis. At the same time, the single point (or at least limited area) of contact between the suspension member and the plate may allow for at least limited rotation of the plate around an axis perpendicular to the first and second axis. Such rotation may be beneficial in some applications.

BRIEF DESCRIPTION OF THE DRAWINGS

The present invention will be described in more detail with reference to the appended drawings, showing currently preferred embodiments of the invention.

DETAILED DESCRIPTION OF PREFERRED EMBODIMENTS

In the following description, currently preferred embodiments of the invention will be described with reference to a paintball marker held in its normal use, upright position. Any relationship or direction such as front, rear, above, bottom, upwards, etc, are thus to be understood as referring to a loader in this position.

Figure 1:
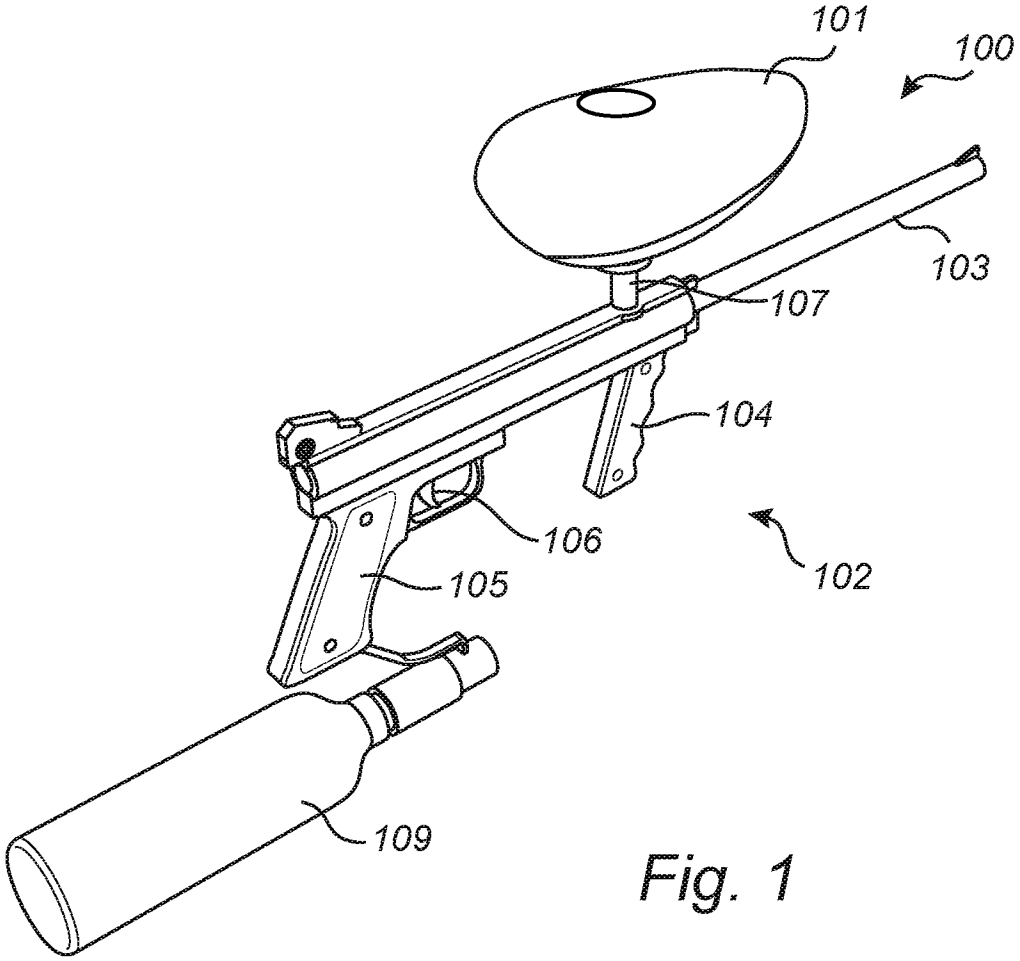
FIG. 1 is a schematic view of a paintball marker with a loader.

FIG. 1 is a schematic perspective view of a paintball marker (or paintball gun) 100 equipped with a paintball loader 101. The paintball marker 100 typically includes a marker body 102 comprising a barrel 103, a front handgrip 104, a rear handgrip 105 and a trigger 106. The paintball marker 100 may also comprise an inlet (not shown) which is connected to an outlet 107 of the paintball loader 101. The inlet receives paintballs from the paintball loader 101 and feeds them to a firing chamber (not shown) in the interior of the marker body 104. A compressed gas cylinder 109 is here mounted to the rear handgrip 105, and is arranged to provide compressed gas, e.g. air, to the firing chamber, thereby propelling a paintball through the barrel 103 and out of the marker 100.

Figure 2A:
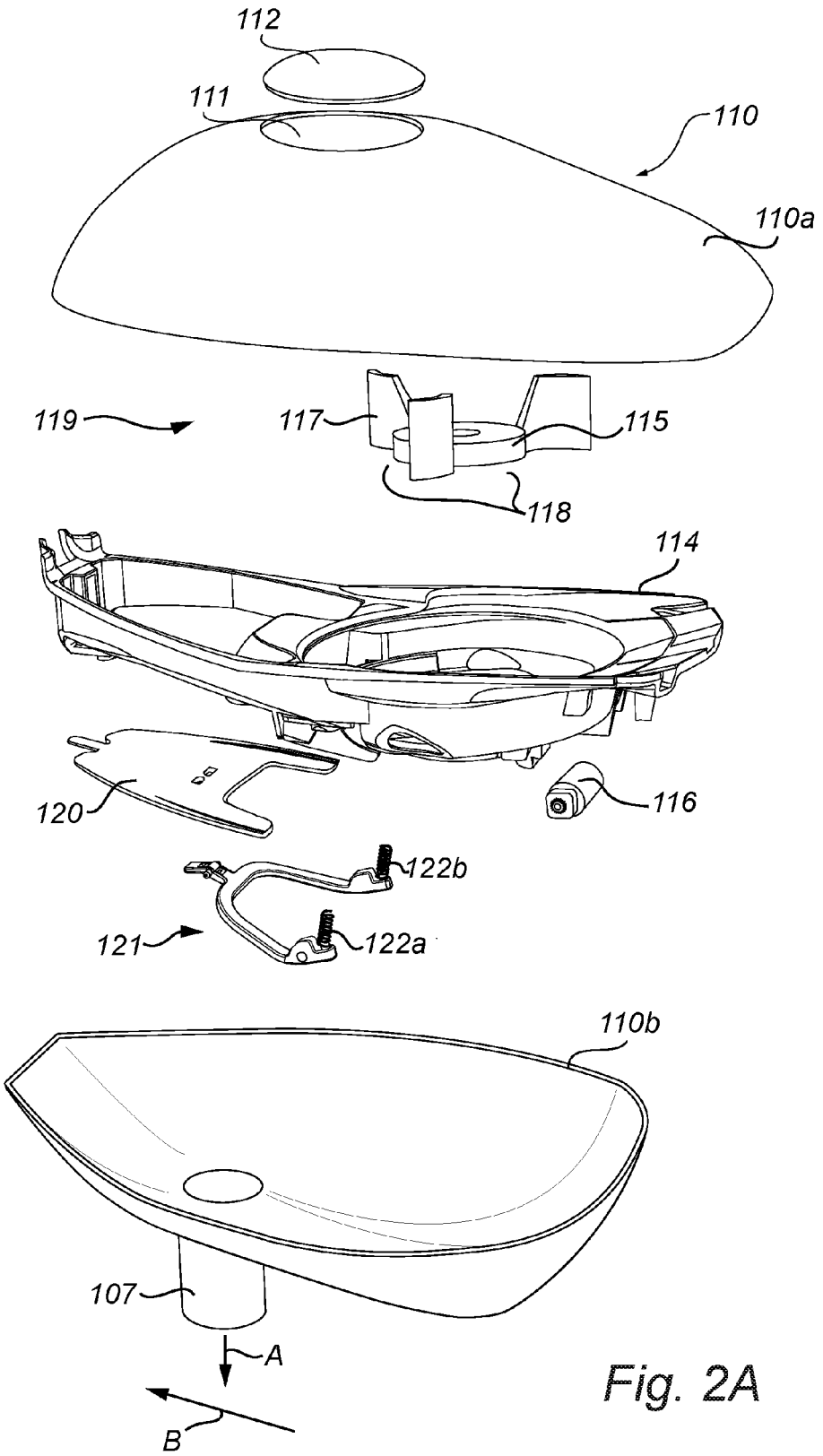
FIG. 2A, 2B are exploded views of a loader according to an embodiment of the present invention.
Figure 2B:
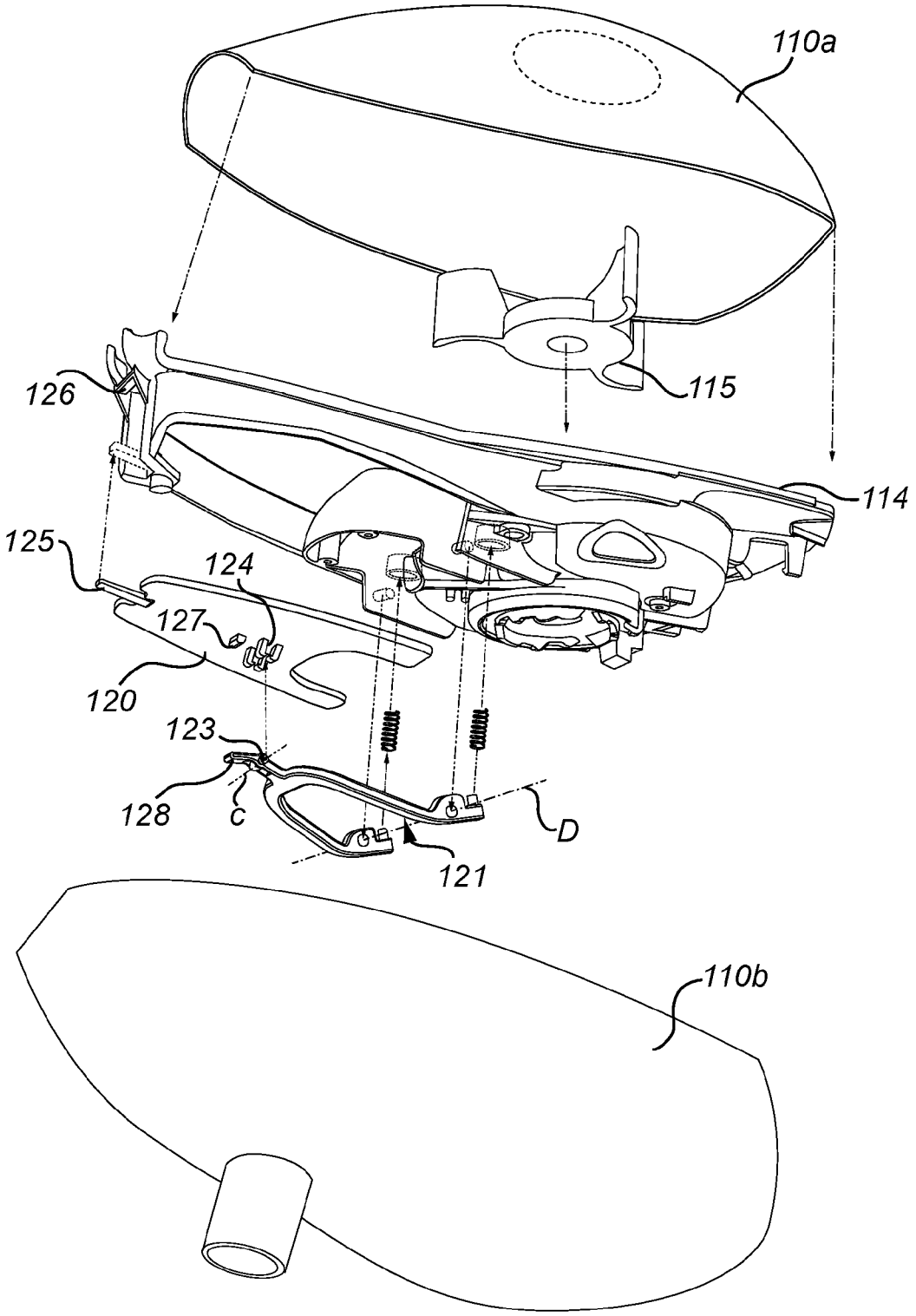

With reference to FIGS. 2A and 2B, the paintball loader 101 comprises a housing 110 including an upper portion 110*a* and a lower portion 110*b*. The upper portion 110*a* is provided with an opening 111 covered by a lid 112. The outlet 107 is formed in the lower portion 110*b*.

Inside the housing 110 is a frame 114, sandwiched between the upper and lower parts 110*a*, 110*b*. The frame 114 is configured to house a paintball feeding arrangement, including a rotating member 115 and an electric motor 116, connected by suitable gears to rotate the rotating member. The rotating member has a plurality of wings 117, and cavities 118 formed between the wings 117. When the rotating member is rotated by the motor, paintballs in the cavities 118 will be pushed by the wings through the outlet 107 in a ball feeding direction A. The cavities thus form the points of entry into the feeding arrangement.

Between the frame 114 and the upper portion of the housing 110*a* is formed a compartment 119 for storing paintballs. The surface of the frame 114 surrounding the feeding arrangement is formed such that when the loader is in an upright position, paintballs will be forced by gravity into the cavities 118 of the rotating member 115.

In front of the feeding arrangement, as seen in the firing direction B of the marker, is an essentially flat supporting plate 120 suspended by a suspension member 121. The suspension member is here a V-shaped link, with the pointed front end of the V connected to the plate 120, and the two legs connected to the underside of the frame 114. The front end is connected to the plate 120 so as to be rotatable around an axis C, essentially perpendicular to the firing direction. In the illustrated example, the front end is formed with two protrusions 123, which are rotatably received by two holders 124. The legs of the V-shaped suspension member 121 are each connected to the frame so as to be rotatable around a common axis D, also essentially perpendicular to the firing direction. For example, the legs may each have a protruding pin, which is received by a corresponding hole in the frame. Two biasing elements, here in the form of coil springs 122*a*, 122*b*, are provided to act between the arms of the V-shaped suspension member 121 and the frame 114, to spring load the suspension member around the axis D, and to thereby press the front end of the suspension member 121, and thus the plate 120, upwards, substantially opposite to the feeding direction A.

With particular reference to FIG. 2B, the plate is further provided with a front protrusion 125 arranged to abut against an abutment 126 in the frame 114. A bump 127 is located centrally on the underside 120*a* of the plate 120 and is arranged to abut a second abutment formed by the tip 128 of the front end of the suspension member 121.

It should be noted that with this design, the suspension member will always be pressed downwards when the plate is depressed. If the front of the plate is depressed (i.e. in front of the axis C), the plate will abut the tip 128 and the plate 120 and the suspension member 121 will rotate together around the axis D. If the rear of the plate is depressed (i.e. behind the axis C) the plate 120 will rotate around the axis C, but the protrusion 125 will abut the abutment 126 thus forcing the connection point between the plate 120 and the suspension member 121 downwards.

Figure 3A:
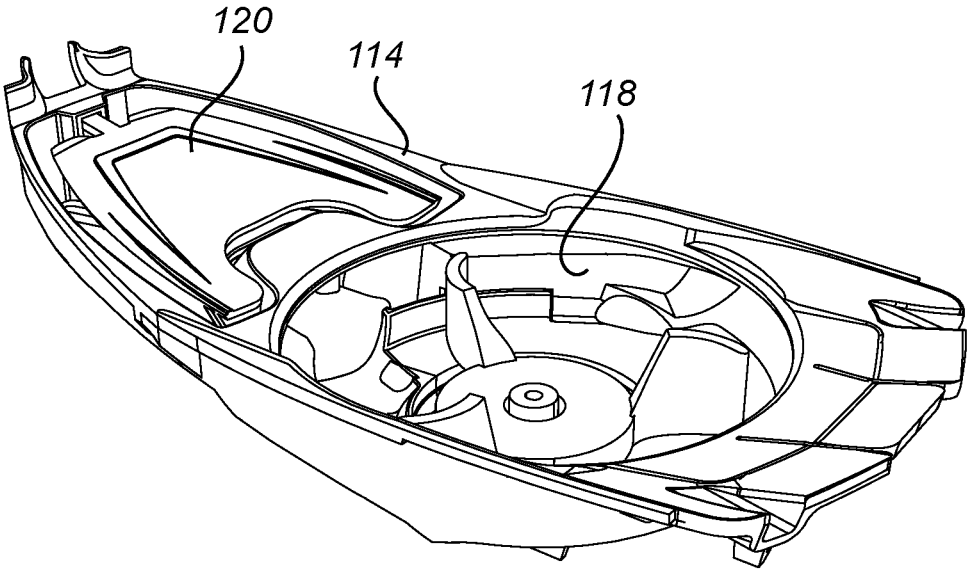
FIG. 3A, 3B are perspective views of the frame in FIG. 2A, 2B with the supporting plate in its first and second position, respectively.

FIG. 3A shows the frame 114 and the plate 120 in a first, raised position, where the suspension member forces the plate 120 into contact with the abutments 126, 128. In this first position, the plate 120 will form a part of the floor of the compartment 119. When the loader is in an upright position, the upper surface of the supporting plate in its first position will slope towards the cavities 118 of the rotating member 115, and allow any paintballs in the compartment 119 to enter the cavities.

Figure 3B:
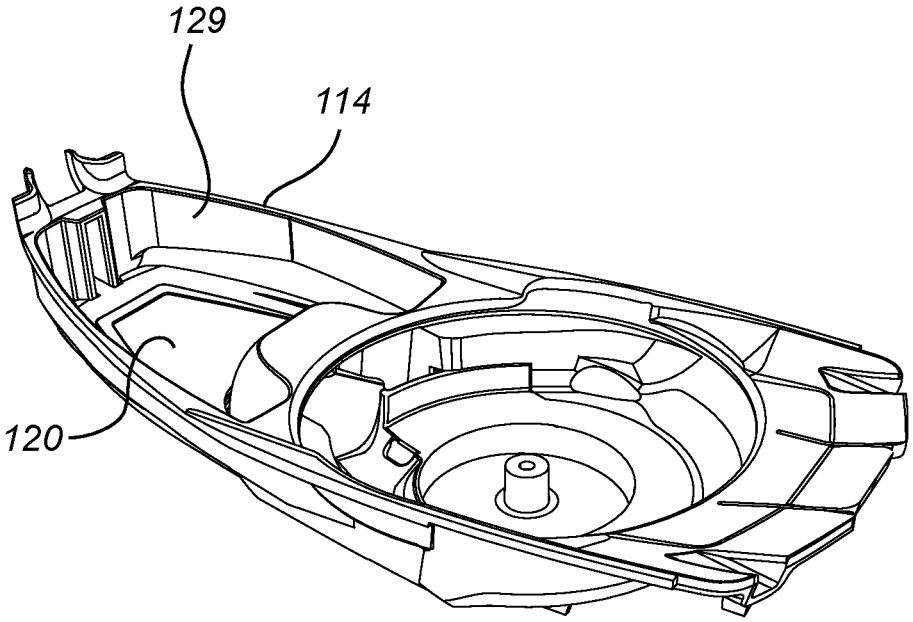

The plate 120 is depressable against the biasing force of the suspension member 121 into a second, lowered position, shown in FIG. 3B. In this position, the entire plate 120 is located below the upper edge of the rotating element, and thus below the entry points of the feeding arrangement, formed by the cavities 118 in the rotating member 115. As can be seen in FIG. 3B, this creates an additional space 129 where paint balls may be stored. The entire plate 120 is here beyond the entry points of the feeding arrangement in the feeding direction A, i.e. below the upper edge of the rotating member 115 when the loader is in the upright position. Paint balls located in this space 129 will not be able to reach the entry points of the feeding arrangement. On the other hand, the space 129 provides storage of an additional number of paintballs, compared to FIG. 3A.

Figure 4A:
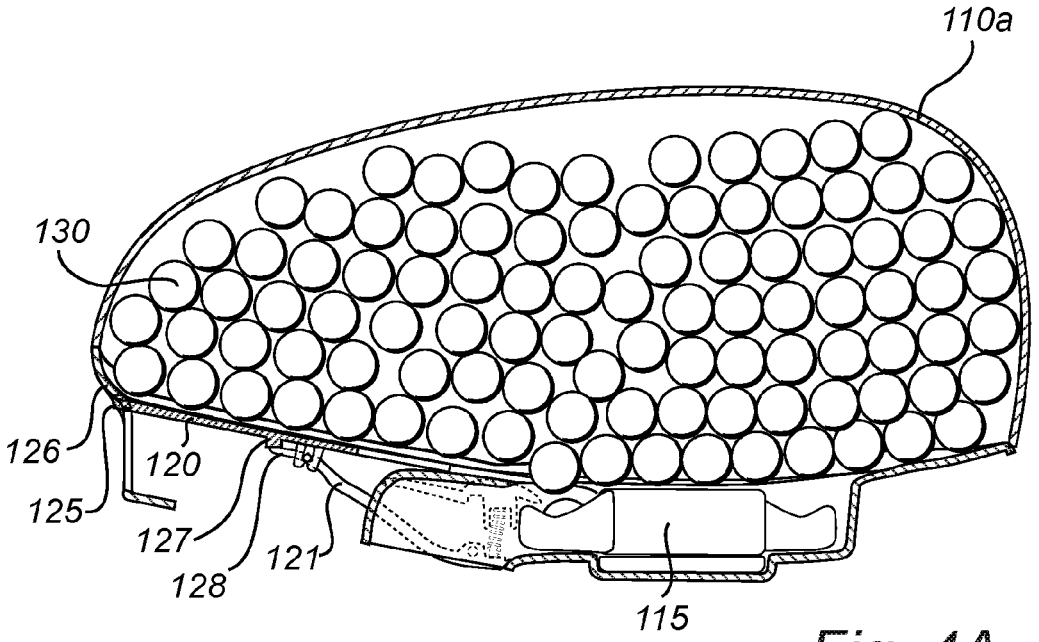
FIG. 4A, 4B are cross section views of the loader in FIG. 2A, 2B, again with the supporting plate in its first and second position, respectively.
Figure 4B:
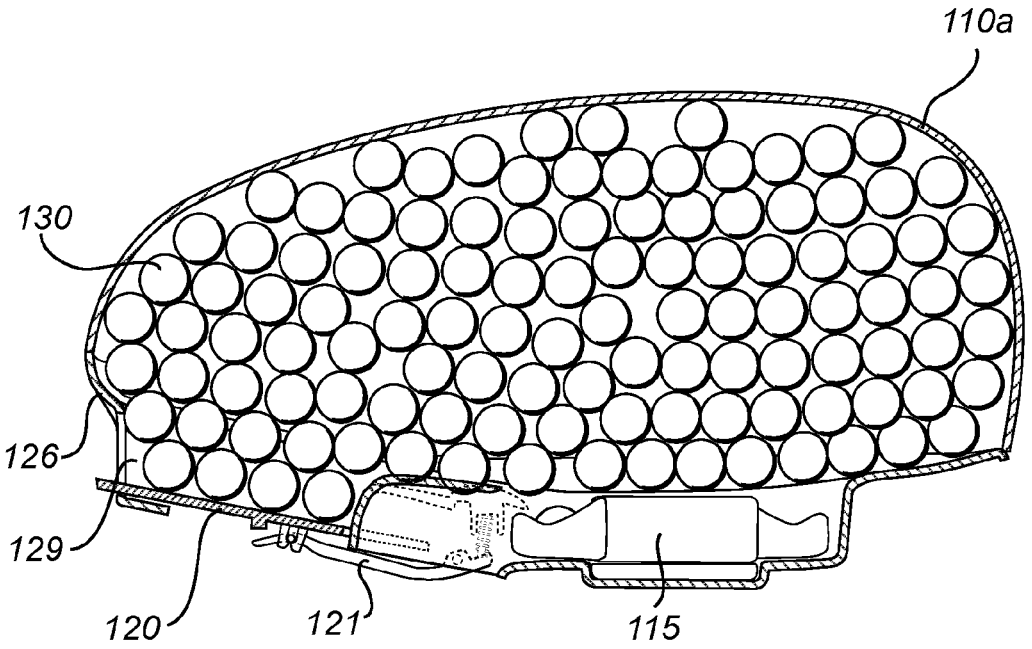

The effect of the two different positions of the plate 120 is more clearly shown in FIGS. 4A and 4B, showing the compartment 119 filled with paintballs 130. In FIG. 4A, with the plate 120 in its first position, the paint balls 130 in the compartment 119 rest against the plate 120 and will be pushed by gravity into the cavities 118 of the rotating member 115. In FIG. 4B the compartment 119 is so full of paintballs 130 that the plate 120 is depressed against the force of the suspension member 121 into the second position. As a result, paintballs 130 can fill also the cavity 129.

Figure 5A:
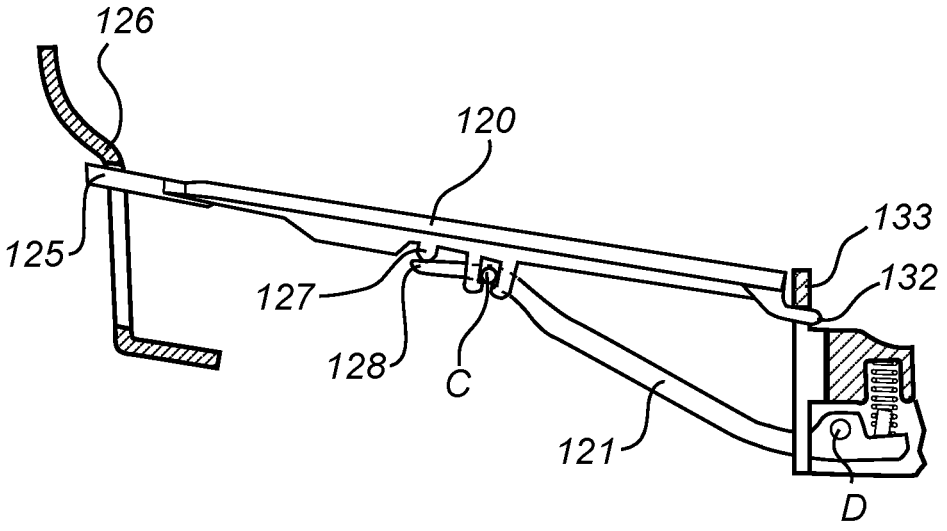
FIG. 5A, 5B are cross section views of the plate and suspension member of a loader according to a different embodiment of the present invention.
Figure 5B:
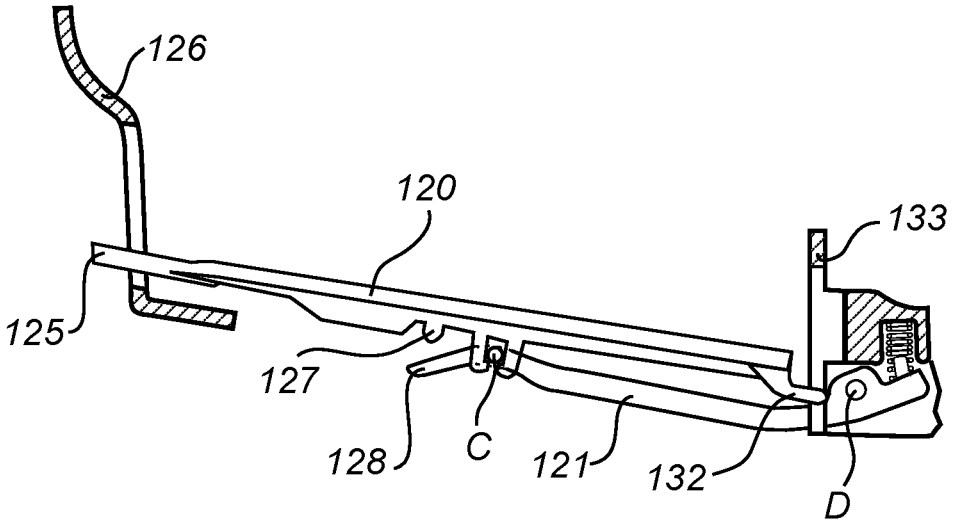

FIGS. 5A and 5B again show the plate 120 in its two positions. In particular, FIG. 5A shows the plate 120 in its raised position, with protrusion 125 abutting the abutment 126, and the bump 127 abutting abutment 128. In the embodiment shown in FIG. 5A, 5B, the plate 120 comprises at least one additional, rear protrusion 132, which abuts an abutment 133 in the frame 114. This additional abutment 133 ensures that the plate 120 in its raised position is flush with the entry points 118 of the feeding arrangement 115, 116. Although not apparent from FIGS. 5A, 5B, there may be two rear protrusions 132, one on each side of the plate, to prevent rotation around a front-rear axis.

The person skilled in the art realizes that the present invention by no means is limited to the preferred embodiments described above. On the contrary, many modifications and variations are possible within the scope of the appended claims.

For example, the supporting plate may be positioned behind the feeding arrangement instead of in front of the feeding arrangement. Further, the frame 114, which here has been described as a separate part, can alternatively be integrated with the lower housing portion 110*b*. The design of the suspension member 121 may also be different, and a H-shape could be an alternative to the V-shape. A H-shaped suspension member 121 would prevent any rotation of the plate 120 with respect to the frame 114.

What is claimed is:

1. A paintball loader adapted to be mounted on a paintball marker, said loader comprising:

a paintball storage compartment for holding a supply of paintballs, an outlet through which a paintball may pass in a feeding direction into a paintball marker on which the loader is mounted, a frame supporting a paintball feeding arrangement for actively feeding paintballs in said compartment through said outlet, said feeding arrangement having one or several points of entry for receiving a paintball, a supporting plate, having a front end, facing an intended firing direction, and a rear end opposite said front end, and at least two abutments, a suspension member having a first end operatively connected to a central region of said supporting plate and a second end operatively connected to said frame, said suspension member being spring loaded to press said supporting plate against said abutments in a direction substantially opposite said feeding direction, wherein said supporting plate is depressable against a force of said spring loaded suspension member, for moving said supporting plate in the feeding direction from a first position, in which said supporting plate is pressed against said abutments and serves to guide paintballs in said compartment towards said points of entry, to a second, depressed position in which the entire plate is moved in said feeding direction completely beyond said points of entry.

2. The paintball loader according to claim 1, wherein the first end of said suspension member is connected to said plate so as to be rotatable around a first axis C.

3. The paintball loader according to claim 2, wherein the second end of said suspension member is connected to said frame so as to be rotatable around a second axis D, parallel to said first axis C.

4. The paintball loader according to claim 3, wherein said suspension member is spring loaded by at least one biasing element provided between said frame and said suspension member.

5. The paintball loader according to claim 4, wherein said at least one biasing element is arranged closer to said second axis D than said first axis C.

6. The paintball loader according to claim 2, wherein said at least two abutments include a front abutment formed in said frame and arranged to abut a front portion of said plate.

7. The paintball loader according to claim 6, wherein said at least two abutments include a central abutment formed in the first end of said suspension member and arranged to abut an underside of said plate in a point located between said first abutment and said first axis C.

8. The paintball loader according to claim 1, wherein said suspension member is generally V-shaped, with two legs which are joined in the first end of the suspension member, and separated in the second end of the suspension member.

9. The paintball loader according to claim 1, wherein said at least two abutments include a rear abutment formed in said frame and arranged to abut a rear portion of said plate.

10. The paintball loader according to claim 1, wherein said feeding arrangement comprises a rotating member with wings and a motor for rotating the rotor, wherein openings of cavities between the wings of the rotating member form points of entry of the feeding arrangement.

11. The paintball loader according to claim 1, wherein said suspension member is spring loaded by at least one biasing element provided between said frame and said suspension member.

12. The paintball loader according to claim 1, wherein said at least two abutments include a front abutment formed in said frame and arranged to abut a front portion of said plate.

* * * * *